United States Patent [19]

Rothenstein

[11] 3,976,522

[45] Aug. 24, 1976

[54] NITROPLASTICIZED AMINE PERCHLORATE FLEXIBLE EXPLOSIVES

[75] Inventor: Julius Rothenstein, Citrus Heights, Calif.

[73] Assignee: The United States of America as represented by the Secretary of the Navy, Washington, D.C.

[22] Filed: July 26, 1971

[21] Appl. No.: 168,506

[52] U.S. Cl. ..... 149/19.4; 149/19.91; 149/75; 149/92; 149/119

[51] Int. Cl.[2] ..... C06B 45/10; C06B 43/00

[58] Field of Search ..... 149/75, 92, 19, 19.4, 149/19.91, 119

[56] References Cited

UNITED STATES PATENTS

| | | | |
|---|---|---|---|
| 3,138,501 | 6/1964 | Wright | 149/92 |
| 3,227,588 | 1/1966 | Jones et al. | 149/92 X |
| 3,296,041 | 1/1967 | Wright | 149/92 X |
| 3,389,026 | 6/1968 | Johnson | 149/19.91 X |
| 3,779,822 | 3/1973 | Stammler et al. | 149/19.4 |
| 3,804,683 | 4/1974 | Baldwin et al. | 149/92 X |
| 3,878,002 | 4/1975 | Baldwin | 149/19.91 |

*Primary Examiner*—Edward A. Miller

*Attorney, Agent, or Firm*—R. S. Sciascia; Charles D. B. Curry

[57] ABSTRACT

A sheet explosive employing a fine particle size filler in which a portion thereof is replaced by a plasticizer diluent providing castability at moderate temperatures while maintaining high rates of detonation. The material is crosslinked under mild conditions to eliminate thermoplasticity.

3 Claims, No Drawings

NITROPLASTICIZED AMINE PERCHLORATE FLEXIBLE EXPLOSIVES

BACKGROUND OF THE INVENTION

1. Field of the Invention

This invention relates generally to a composition which employs a unique explosive filler, preferably of fine particle size, either predominantly or exclusively to insure minimal critical thickness for detonation. Replacing a portion of the explosive filler with an energetic, compatible plasticizer diluent provides castability at moderate temperatures while maintaining the required high rates of detonation and effecting a crosslinked polymeric network under mild curing conditions to eliminate undesirable thermoplasticity.

2. Description of the Prior Art

There are a limited number of alternative high explosive compositions that are readily processable, safe to handle, have appropriate high rates of detonation, suitable low critical thickness propagation and with the specific physical properties to qualify as flexible sheet explosives. Of the explosives that qualify or meet the requirements, such as the Military Specification (MIL Spec.), the most widely known of these compositions are those designated as "Deta Sheet", extrudable compositions containing 63 – 75% pentaerythritol tetranitrate (PETN), cyclotrimethylene trinitramine (RDX) or cyclotetramethylene tetranitramine (HMX) in a plasticized elastomeric binder. All of the aforementioned compositions are referred to hereinafter as PETN, RDX, and HMX, respectively.

Qualified sheet explosives are unique in their own right because they fulfill certain needs that cannot readily be met by other kinds of explosive materials. They are sturdy, durable, have uniform detonation velocity and a high degree of safety. Moreover, they are waterproof, insensitive to shock, easy to cut into any desired shape and easily applied. Among the more widely known applications are their use in metal cutting, hardening, general demolition, and safe-arm devices.

Explosive compositions which presently are used in applications requiring flexible sheet have certain inherent shortcomings. Generally, these fall into the following categories. The fabrication techniques are limited to extrusion because of the thermoplastic nature of the binder; the binder thermoplasticity limits the temperature of potential application or use; and the relatively low explosive filler concentration ordinarily required to provide castable systems reduces the detonation rate and/or increases the critical thickness required for detonation propagation.

SUMMARY OF THE INVENTION

The present invention overcomes the difficulties inherent in the prior explosive compositions by employing a unique explosive filler, preferably of fine particle size, either predominantly or exclusively, to insure minimal critical thickness for detonation propagation and replacing a portion of the explosive filler with an energetic, compatible plasticizer diluent that provides castability at moderate temperatures while maintaining the required high rates of detonation. Moreover, it has been found that the unique concept will affect the crosslinked polymeric network under mild curing conditions to eliminate undesirable thermoplasticity.

STATEMENT OF THE OBJECTS OF INVENTION

A primary object of the present invention is to provide a unique explosive filler to insure minimal critical thickness for detonation.

Another object of the present invention is to provide an explosive filler with an energetic, compatible plasticizer diluent that allows castability at moderate temperatures while maintaining high rates of detonation.

Another object of the present invention is to provide a unique explosive filler which will affect the crosslinked polymeric network under mild curing conditions to eliminate undesirable thermoplasticity.

Other objects, advantages and novel features of the unique present invention will become apparent from the following detailed description of the invention.

DESCRIPTION OF THE PREFERRED EMBODIMENTS

Castable explosive compositions which exhibit all the desired properties required of flexible explosives have been incorporated into a curable prepolymeric binder portion in combination with an explosive filler such as amine perchlorates as represented by methylamine perchlorate (MAP) and ethylenediamine diperchlorate $\frac{1}{2}H_2O$ (EDD). The fillers may be coated with a suitable desensitizing agent if desired. The amine perchlorate explosive fillers may be used independently, or in combination with each other, or in combination with other particulate explosive ingredients such as RDX, HMX, PETN, ammonium perchlorate or ammonium nitrate, or liquid explosive materials such as compounds similar to mixtures of bis (2,2-dinitropropyl) formal (BDNPF) and bis(2,2-dinitropropyl)acetal (BDNPA) hereinafter referred to as BDNPF and BDNPA, respectively. While the preferred concentration of the amine perchlorate explosive filler will be dependent upon the choice and concentration of other explosive materials, a useful composition would contain amine perchlorate levels of about 55 – 75% of the composite explosive which additionally contains a binder portion comprised of a readily curable prepolymer that is a crosslinking agent, such as a similar prepolymer, a curing agent, a catalyst, or other desired additive, and a compatible energetic plasticizer diluent such as compounds similar to mixtures of BDNPF and BDNPA, in preferred concentrations at or near 75% of the binder by weight. However, the concentrations of the explosive filler and the energetic diluent are limited only by the desired processability, physical properties and explosive characteristics of said composite. The preferred concentrations, therefore, merely represent desirable levels for selected applications and are not intended to limit the available alternatives.

The readily curable prepolymer may be of the type described by the following composition, but not limited to those that are readily soluble or dispersible in and/or fusible with other components in the explosive composition which may readily polymerize with a curing agent to thermally stable flexible polymers compatible with high concentrations of desired diluents or plasticizer during any stage of cure or crosslinking as exemplified by highly polar prepolymers of the type with active hydrogens capable of forming polyurethanes, such as those with essentially two hydroxy groups as the polyoxyethylene glycols or more energetic prepolymers with essentially two but frequently with less than or more than two hydroxy groups, such as copolymers of dinitropropyl acrylate and hydroxyalkylacrylates of molecular weights, the number of equivalents limited only by the desired properties of the uncured and/or of the cured composite explosive. Optional fillers or additives as inert inorganic materials, such as aluminum or aluminum oxide or pigments such as lead chromate or organic materials suitable for use as antioxidants or stabilizing agents, such as the class of compounds exemplified by phenyl-beta-naphthylamine or other materials that are useful to improve processing, cure or properties of the uncured or cured explosive compositions or any mixtures or particle sizes of the aforementioned fillers and the energetic diluent or plasticizer as described above. The crosslinking agent in the case of a polyurethane-cured prepolymer of a type as polyfunctional hydroxyl compounds, such as trimethylol propane or polyoxyethylene adducts of tri-methylol propane or sorbitol, in a number of equivalents limited only by the desired properties of the uncured and/or of the cured composite explosive. A curing agent in the case of a polyurethane prepolymer of a type similar to polyfunctional isocyanates such as toluene diisocyanate or polymethylene polyphenylisocyanate, in a number of equivalents, are limited only by the desired properties of the uncured and/or of the cured composite explosive, and a cure catalyst, if desired, in the case of a polyurethane prepolymer of the type and including ferric acetylacetonate in a concentration limited only by the desired properties of the uncured and/or the cured explosive.

The basic flexible explosive composition of the present invention generally comprises an explosive filler and a binder, said binder comprising a mixture of a readily curable prepolymer, a crosslinking agent and a curing agent. Specific examples of this composition are set forth below, in parts by weight.

EXAMPLE I

| | |
|---|---|
| RDX, wt% | 0.0 |
| MAP, wt% | 65.0 |
| Nitroplasticizer, wt% | 25.8 |
| Binder, wt% | 9.2 |

The composition set forth in Example I is suitable for, but not limited to, applications requiring properties commonly exhibited by flexible explosives. The composition set forth in this Example was prepared in a 50 gram size batch by mixing at 135° – 140°F, 65.0 weight percentage of MAP together with prepolymer portion comprised of 13 equivalents of polyoxyethylene glycol 4000 (equivalent weight 2217), 87 equivalents of trimethylolpropane (equivalent weight 45) and 107 equivalents of tolylenediisocyanate (equivalent weight 87) plasticized 75 percentage by weight with a 1:1 mixture of BDNPF and BDNPA, containing 0.25 weight percentage of Phenylbeta-naphthylamine antioxidant and 0.020 weight percentage of ferric acetylacetonate catalyst. The aforementioned composition is then cured in a standard manner. Critical thickness propagation, physical and explosive characteristics of this formulation are shown in Table I. The effect of MAP concentration on the critical thickness of this and other flexible explosive formulations is shown in Table I. The explosive is readily castable into any size or shape. For example, it may be cast and subsequently cured under ambient conditions to uniform, flexible, tough films or sheets having any desired thickness with a density of 1.512 g/cc, a detonation velocity of 7000 meters/second and a critical propagation thickness of 0.08 inches initiated with a No. 6 blasting cap and an impact sensitivity of 8 cm/2Kg.

EXAMPLE II

| | |
|---|---|
| RDX, wt% | 39.2 |
| MAP, wt% | 26.0 |
| Nitroplasticizer, wt% | 25.8 |
| Binder, wt% | 9.0 |

The composition set forth in Example II is suitable for, but not limited to, applications requiring properties commonly exhibited by flexible explosives. The composition set forth in Example II was prepared in a 100 gram batch by mixing at 90° – 95°F, 26.0 weight percentage of MAP desensitized with all the PEG 4000 (13 equivalents) and TMP (87 equivalents) in the formulation (total desensitizer = 24.4 weight percentage of MAP) and 39.0 weight percentage of Class E RDX (approximately 97% –325 mesh, average particle size 15–20 micron) desensitized with 0.5 weight percentage of dioctyl adipate by weight RDX, together with the remainder of the prepolymer portion, 107 equivalents of tolylene diisocyanate, plasticized with 75 weight percentage with a 1:1 mixture of BDNPF and BDNPA, containing 0.25 weight percentage of phenyl-beta-naphthylamine antioxidant, and 0.001 weight percentage ferric acetylacetonate catalyst. The aforementioned composition is then cured in a standard manner. Pertinent data is shown in Table I. The explosive is readily cast into any size or shape. For example, it may be cast and subsequently cured under ambient conditions to uniform, flexible, tough films or sheets having any desired thickness, with a density of 1.572 g/cc, a detonation velocity 7400 meters/second and a critical propagation thickness of 0.10 inches initiated with a No. 6 blasting cap and an impact sensitivity of 52 cm/2Kg.

EXAMPLE III

| | |
|---|---|
| RDX, wt% | 65.0 |
| MAP, wt% | 0.0 |
| Nitroplasticizer, wt% | 25.8 |
| Binder, wt% | 9.2 |

The composition shown in Table I is used as a standard control composition. The use of 100% RDX is illustrated as a comparison to Examples I and II.

TABLE I

| | Example I | Example II | Example III |
|---|---|---|---|
| RDX, wt% | — | 39.2 | 65.0 |
| MAP, wt% | 65.0 | 26.0 | — |
| Nitroplasticizer, wt% | 25.8 | 25.8 | 25.8 |
| Binder, wt% | 9.2 | 9.0 | 9.2 |
| Minimum Propagation Thickness unconfined, inches (1) | 0.080 | 0.100 | 0.135 |

-continued

TABLE I

| | Example I | Example II | Example III |
|---|---|---|---|
| Bureau of Mines Impact Sensitivity, 50% pt. cm/2Kg | 8 | 52 | 77 |
| Rotary Friction Sensitivity, gram load | 1820 | 6000 | 6000 |
| rpm | 3000 | 4000 | 4000 |
| Electrostatic Sensitivity, joules | 2.32 | 1.75 | 2.63 |
| DTA Endothermic Peaks, °F | 119,342 | 113,306 | 356 |
| DTA Onset Point to Exotherm, °F | 390 | 351 | 372 |
| DTA Exothermic Peaks, °F | 501 | 377 | 387,448 |
| Density, gm/cc | 1.512 | 1.572 | 1.610 |
| Vacuum Stability, 48 hrs at 100°C, ml gas/gm | 1.014 | — | 0.345 |

Example III constitutes another embodiment of the present inventive concept. In this embodiment it has been found that an explosive with adequate detonation velocity may be provided by eliminating the use of MAP. However, it is to be understood that higher detonation velocity may be obtained by the use of MAP, as set forth in Examples I and II.

What is claimed is:

1. A castable, thermally stable, non-thermoplastic flexible explosive comprising an explosive filler consisting of a mixture of methylamine perchlorate and cyclotrimethylene trinitramine and a binder, said binder consisting of a mixture of a readily curable prepolymer from the group consisting of a polyurethane, a copolymer of dinitroropyl acrylate and a copolymer of hydroxyalkylacrylates, a crosslinking agent and a curing agent.

2. The composition recited in claim 1 wherein said binder includes an energetic plasticizer diluent of a mixture of bis(2,2-dinitropropyl)formal and bis(2,2-dinitropropyl)acetal.

3. The composition recited in claim 1 wherein said mixture is from about 55% to about 75% by weight of said composition.

* * * * *